US006082632A

United States Patent [19]

Clark et al.

[11] Patent Number: 6,082,632

[45] Date of Patent: Jul. 4, 2000

[54] CO-MOLDED SPLIT CONTAINMENT RING FOR RISER RETRACTION SPRING OF A POP-UP SPRINKLER

[75] Inventors: Mike Clark, San Marcos; Roger Wilby, Fallbrook, both of Calif.

[73] Assignee: Hunter Industries, Inc., San Marcos, Calif.

[21] Appl. No.: 09/143,906

[22] Filed: Aug. 31, 1998

[51] Int. Cl.[7] ..... B05B 15/10

[52] U.S. Cl. ..... 239/205; 277/549

[58] Field of Search ..... 239/203, 204, 239/205, 206, 533.15; 277/549, 570, 650, 936, 944, 627; 264/259, 269, 268, 241; 425/130

[56] References Cited

U.S. PATENT DOCUMENTS

| | | | |
|---|---|---|---|
| 3,697,090 | 10/1972 | Brenneke | 277/231 |
| 4,328,972 | 5/1982 | Albertson et al. | 277/1 |
| 5,222,669 | 6/1993 | Lawson | 239/205 |

*Primary Examiner*—Steven O. Douglas
*Assistant Examiner*—Huyen Le
*Attorney, Agent, or Firm*—Michael H. Jester

[57] ABSTRACT

A pop-up sprinkler includes an outer cylindrical fixed housing for subsurface mounting and a riser reciprocally mounted in a central bore of the housing. Pressurized water causes the riser to extend and place a nozzle at its top end above the surface of the ground. A radially retractable and expandable containment ring is mounted at an outlet end of the housing and engages an annular inner shoulder of the housing for retaining a coil spring. The spring retracts the riser when the pressurized water is turned OFF. The containment ring includes a substantially rigid support ring and an elastomeric sealing ring co-molded thereto. The support ring is split to enable radial expansion and retraction due to its resiliency. The elastomeric sealing ring spans the gap between the opposite ends of the support ring. The elastomeric sealing ring has a tapered edge that extends radially inwardly to engage the riser. When the containment ring is installed in its retaining position, the elastomeric sealing ring prevents dirt and/or other debris from entering the clearance space between the outer housing and the riser that might otherwise impair full extension and/or retraction of the riser.

16 Claims, 5 Drawing Sheets

CO-MOLDED SPLIT CONTAINMENT RING FOR RISER RETRACTION SPRING OF A POP-UP SPRINKLER

BACKGROUND OF THE INVENTION

The present invention relates to irrigation sprinklers, and more particularly, to an improved containment ring for pop-up sprinklers.

Pop-up sprinklers are widely used in both residential and commercial applications to irrigate lawns and shrubs. They typically include a tubular riser that is axially retracted into a fixed cylindrical outer housing buried in the ground when not in use, and which extends from the cylindrical outer housing to a position above the surface of the ground when water pressure is applied. The top of the riser is level with the ground when retracted. A coil spring surrounds the riser within the cylindrical outer housing and retracts the riser when the water source to the sprinkler is shut off. The upper end of the coil spring is held in place by a containment ring that seats against a shoulder at the upper end of the cylindrical outer housing.

In many applications of pop-up sprinklers, such as playing fields, golf courses and the like, it is important that the tops of the risers of the sprinklers reliably retract to a position level with the surface of the playing field, so that they do not become obstacles. However, the typical riser of a conventional pop-up sprinkler frequently jams or sticks in a partially retracted position. This usually occurs when dirt and/or other debris get into the cylindrical housing between the containment ring and the riser.

In a conventional pop-up sprinkler the riser and its retraction spring are assembled into the fixed outer housing from the top. These components are typically retained in place by a substantially rigid hard plastic containment spring which snaps into an annular groove at the top of the fixed outer housing. The containment ring is split so that it can be compressed inward in diameter and inserted into the upper end of the bore of the fixed outer cylindrical housing. The containment ring is then allowed to expand to engage in the annular groove in the outer housing bore to retain the riser in the housing. The containment ring has a sufficient gap at its split to enable the ring to be radially compressed sufficiently to be inserted into the bore of the outer housing. When the containment ring expands into the annular groove, the vertical opposing faces or ends of the ring spread apart, leaving a gap which allows dirt and/or other debris to enter the cylindrical outer housing. This can cause the riser to jam in extended position.

It would be undesirable to utilize a rigid plastic split ring with a separate underlying elastomeric washer as a seal to prevent the entry of debris. This is because customers who must remove the riser for servicing would have a great deal of difficulty reinstalling an elastomeric washer and a separate rigid split containment ring.

It is, therefore, desirable that an improved containment ring be available to hold a riser retraction spring inside the fixed outer housing of a pop-up sprinkler that would reduce the entry of dirt and/or other debris into the outer housing of the sprinkler.

SUMMARY OF THE INVENTION

It is, therefore, the primary object of the present invention to provide an improved containment ring for a pop-up sprinkler.

In accordance with the present invention, a containment ring for the riser retraction spring of a pop-up sprinkler has a resilient support ring molded of a substantially rigid material and a sealing ring made of an elastomeric material that is connected to the support ring. The support ring has opposite ends defining a gap therein so that it is radially retractable and expandable. The elastomeric sealing ring extends across the gap. After installation in the outer housing of the sprinkler, the containment ring is located in a radially expanded retaining position engaging an annular shoulder at the outlet end of the housing. The sealing ring prevents dirt and/or other debris from entering between the housing and the riser that might impair full extension and/or retraction of the riser.

BRIEF DESCRIPTION OF THE DRAWINGS

The above and other object and advantages of the present invention will become apparent from the following description when read in conjunction with the accompanying drawings wherein.

DETAILED DESCRIPTION OF THE PREFERRED EMBODIMENT

Figure 1:
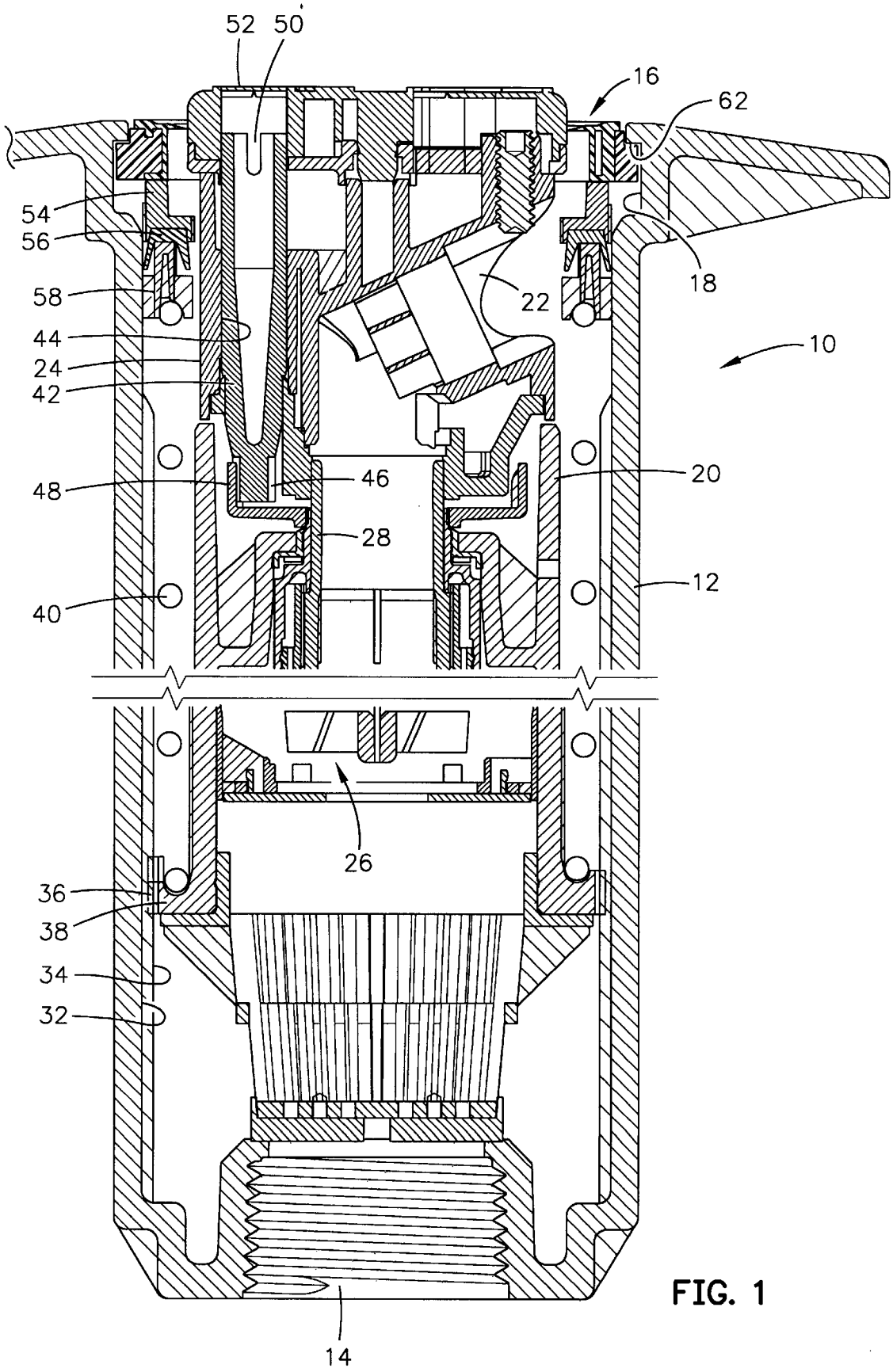
FIG. 1 is a fragmentary vertical sectional view illustrating a pop-up sprinkler including a preferred embodiment of a containment ring in accordance with the present invention.

Referring to FIG. 1 of the drawings, there is illustrated a pop-up sprinkler 10 having a containment ring 16 constructed in accordance with a preferred embodiment of the present invention. The sprinkler 10 is shown in FIG. 1 with its riser 20 in its retracted position. Unless otherwise indicated, the sprinkler 10 is made of injection molded plastic parts. The sprinkler 10 comprises a generally cylindrical fixed outer housing 12, having a lower end 14 threaded for connection to the end of a fitting or pipe (not illustrated) coupled to a source of pressurized water (not illustrated). An upper outlet end of the outer housing 12 is provided with the containment ring 16 in accordance with the present invention. The ring 16 is detachably mounted in the housing 12 by means of an annular groove or recess 18 for retaining a riser retraction spring 40.

The riser 20 (FIG. 1) is mounted for vertical reciprocal movement along the central vertical axis of the outer cylindrical outer housing 12. The riser 20 includes a nozzle 22 in an upper end thereof The nozzle 22 is mounted in a rotatable head 24 and driven by means of a turbine 26. A reduction gear drive train (not illustrated) permits the turbine 26 to rotate a large hollow shaft 28 that turns the head 24, as is well known in the art. The sprinkler 10 may have a drive train designed to continuously rotate the head 24 about the central axis of the outer housing 12, or it may be designed to oscillate. In the later case, the sprinkler 10 is provided with arc adjustment means for alternate rotation of the head 24 through selectively adjustable arcs.

The head 24 (FIG. 1) is mounted for rotation on the upper end of the hollow tubular shaft 28 through which water flows to the nozzle 22. The head 24 is also mounted for selective rotation relative to the shaft 28 about its vertical axis in order to orient the direction of the nozzle 22 relative to the shaft 28. A rotatable shaft 42 is mounted in a bore 44 in the head 24 and carries a pinion gear 46 which drivingly engages a ring gear 48 on the shaft 28. The shaft 42 includes a tool slot 50 at the top of the sprinkler 10 for receiving a screw driver for rotating it. An elastomeric cap 52 protectively covers the entire top of the sprinkler 10 with a self-closing opening that provides access to the tool slot 50. The self-closing opening may be defined by criss-cross slits in the elastomeric cap 52.

The riser 20 (FIG. 1) is reciprocally mounted within a large interior central bore 32 of the outer housing 12. The riser 20 is oriented about its central vertical axis by internal ribs 34 and by means of teeth 36 on a radial flange 38 at the lower end thereof The lower end of the spring 40 engages a shoulder or flange 38 at the lower end of riser 20. The upper end of the spring 40 is retained by the containment ring 16. The containment ring 16 is removably mounted in the upper end of the fixed outer housing 12. The spring 40 normally biases the riser 20 to its lowermost or retracted position as shown in FIG. 1 wherein the sprinkler head 24 is fully retracted within the outer housing 12. When the source of pressurized water to the inlet end 14 of the housing 12 is turned ON, the riser 20 extends and the spring 40 is compressed. When the source of pressurized water is turned OFF, the force of the compressed spring 40 retracts the riser 20 to its lowermost position in which it is substantially concealed within the outer housing 12.

The riser 20 (FIG. 1) with its retraction spring 40 is inserted into the bore 32 from the top of the housing 12. The containment ring 16 is engaged into the annular groove 18 formed in the interior wall at the upper end of the housing 12. A seal assembly is disposed between the containment ring 16 and the upper end of retraction spring 40. The seal assembly includes an upper ring 54 engaging the bottom of the containment ring 16 and a lip seal 56. The lip seal 56 sits on tip of a seating ring 58 that holds the upper end of the retraction spring 40. Thus it will be understood that the containment ring 16 indirectly retains the upper end of the spring 40 via the intermediate upper ring 54 and lip seal 56.

Figure 4:
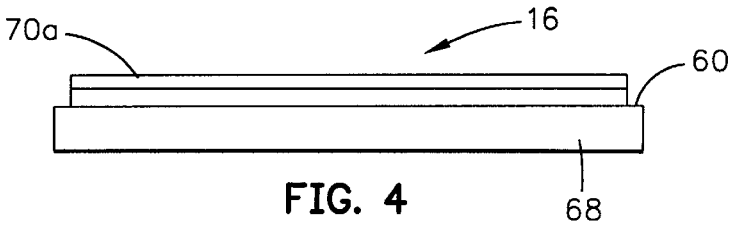
FIG. 4 is a side elevation view of the containment ring of FIG. 2.
Figure 5:
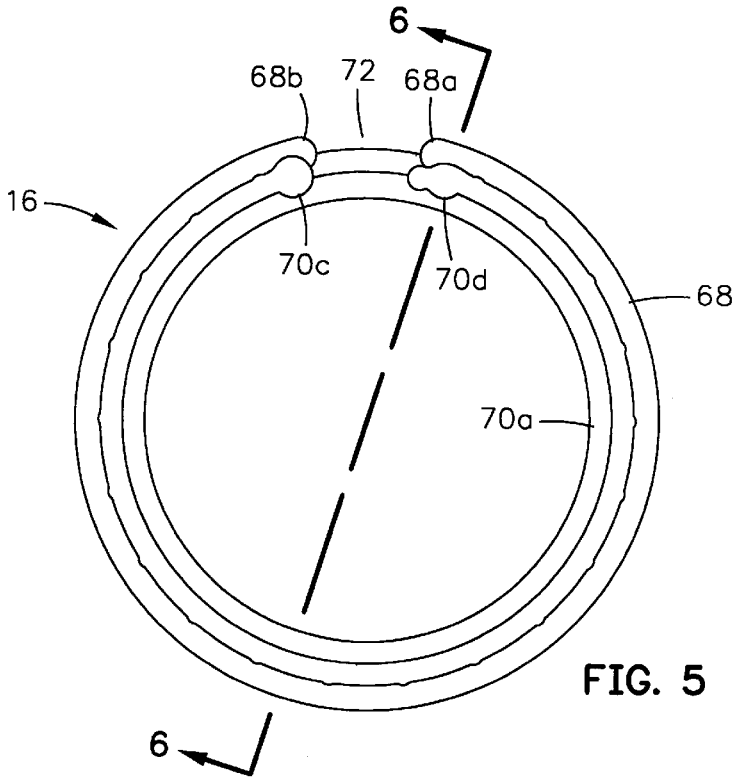
FIG. 5 is a bottom plan view of the containment ring of FIG. 2.
Figure 6:
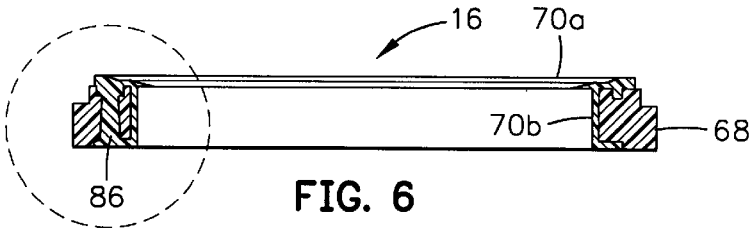
FIG. 6 is a vertical sectional view of the containment ring taken along line 6—6 of FIG. 5.
Figure 7:
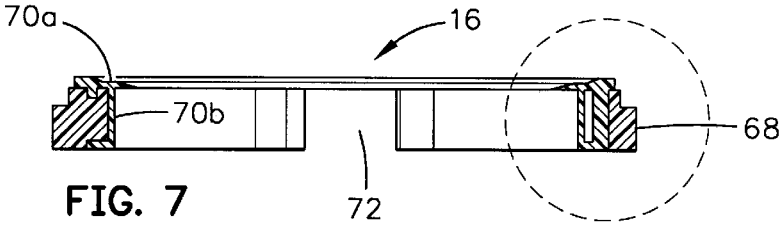
FIG. 7 is a vertical sectional view of the containment ring taken along line 7—7 of FIG. 3.

The containment ring 16 (FIG. 2) is formed with a stepped outer peripheral surface forming a shoulder 60 (FIG. 4) which engages an annular shoulder 62. The annular shoulder 62 is formed by the upper horizontal portion of the groove 18 of the outer housing 12.

Figure 2:
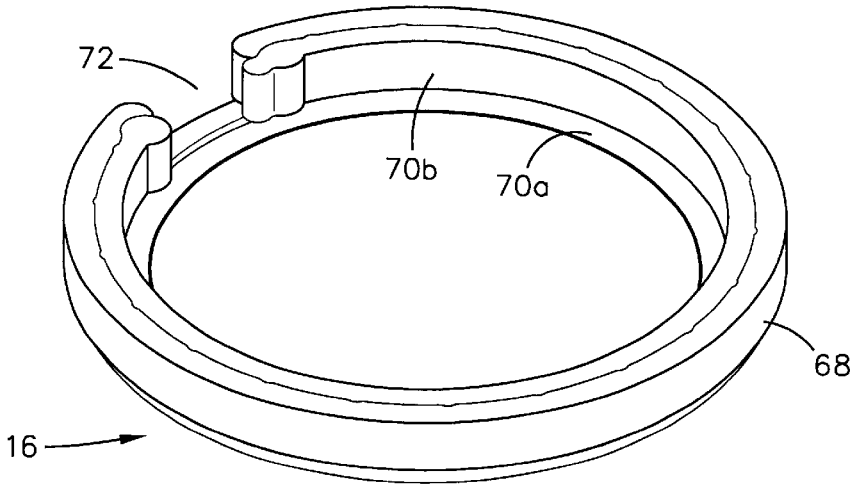
FIG. 2 is a perspective view of the containment ring utilized in the pop-up sprinkler of FIG. 1 taken from the bottom side thereof.
Figure 3:
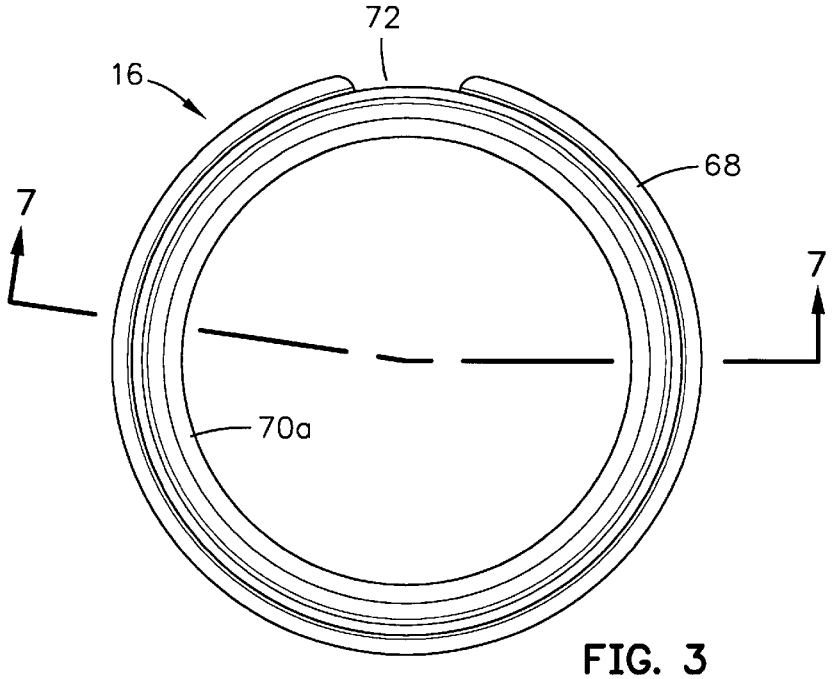
FIG. 3 is a top plan view of the containment ring of FIG. 2.

Referring to FIG. 2 the illustrated containment ring 16 comprises a radially retractable circular member adapted for mounting at the outlet end of the sprinkler housing 12. The containment ring 16 engages the annular shoulder 62 of the outer housing 12 for retaining the retraction spring 40 and the riser 20 in the bore 32. The containment ring 16 comprises a support ring 68 (FIGS. 10) and a sealing ring 70 (FIG. 9) which is connected to the support ring.

Details of the construction of the containment ring 16, including both the support ring 68 and the sealing ring 70, and the manner in which they are securely connected, are illustrated in FIGS. 2–9. Details of the construction of the support ring 68 alone are illustrated in FIGS. 10–17. The sealing ring 70 is not illustrated alone in the drawing figures.

The support ring 68 is made of a substantially rigid material such as black ACETEL (Trademark) polymer commercially available from BASF Corporation. This material may be injection molded and has sufficient strength to withstand the high loads encountered in high pressure irrigation systems, e.g. up to three-hundred pounds. Such loads are sometimes encountered when the riser 20 is extended in response to high pressure water being introduced into the inlet end 14 of the fixed outer housing 12. The support ring 68 has a split configuration that forms a slight gap 72 (FIG. 10) between the opposing ends 68*a* and 68*b* thereof The support ring 68 can be radially compressed manually or with a tool. Upon release of the compressive force, the resilience of its material causes it to spring back, i.e. radially expand, to its original diameter. The spring-like property or resilience of the support ring 68 is attributable to its rigid plastic construction.

Figure 9:
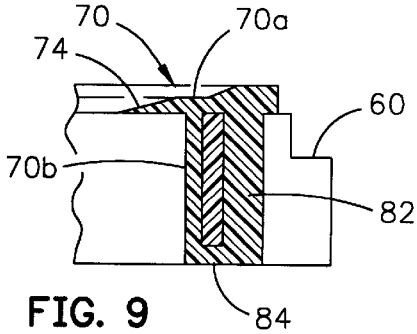
FIG. 9 is an enlargement of the circled portion of FIG. 7.
Figure 10:
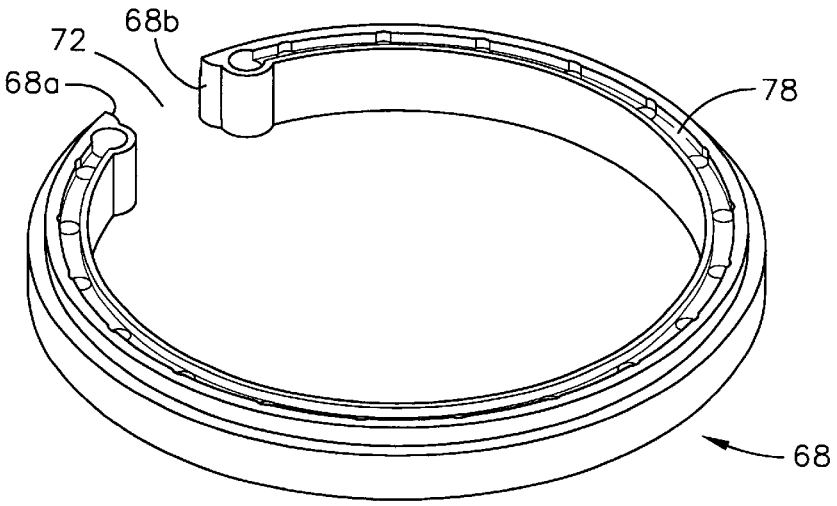
FIG. 10 is a perspective view of the support ring that forms a part of the containment ring of FIGS. 2–7 taken from the top side thereof.
Figure 11:
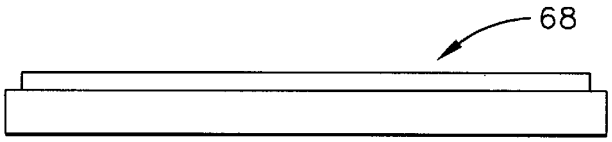
FIG. 11 is a side elevation view of the support ring of FIG. 10.
Figure 12:
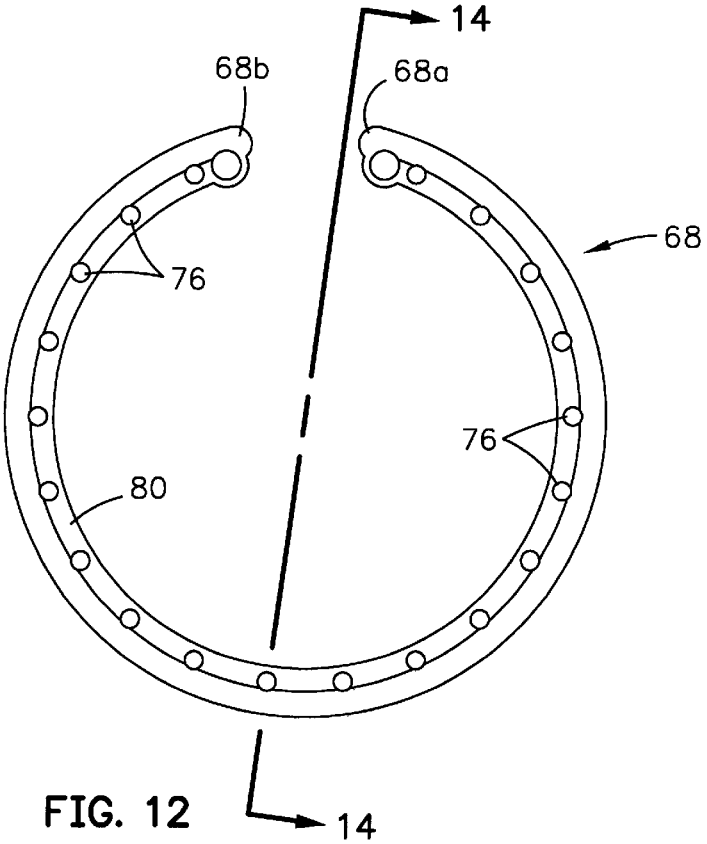
FIG. 12 is a bottom plan view of the support ring of FIG. 10.
Figure 13:
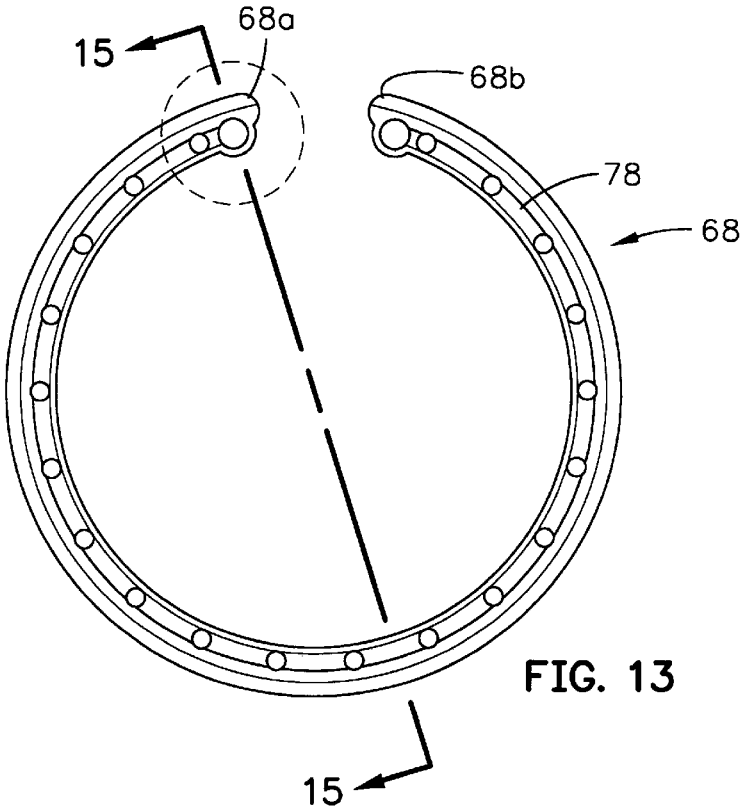
FIG. 13 is a top plan view of the support ring of FIG. 10.
Figure 14:
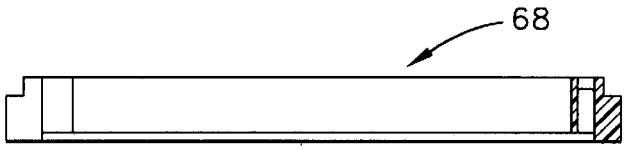
FIG. 14 is a vertical sectional view of the support ring taken along line 14—14 of FIG. 12.
Figure 15:
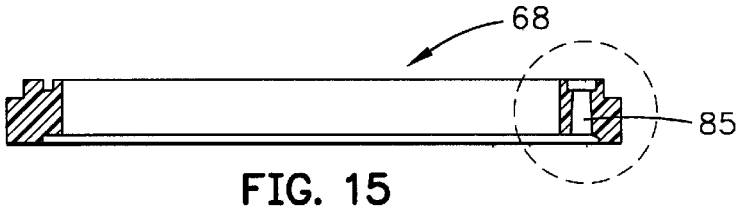
FIG. 15 is a vertical sectional view of the support ring taken along line 15—15 of FIG. 13.
Figure 16:
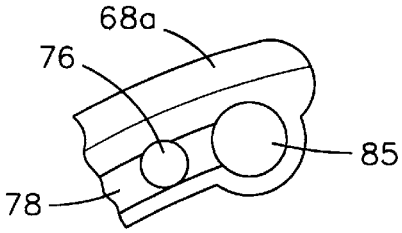
FIG. 16 is an enlargement of the circled portion of FIG. 13.
Figure 17:
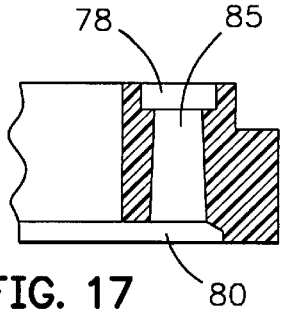
FIG. 17 is an enlargement of the circled portion of FIG. 15.

The sealing ring 70 (FIG. 9) is made of an elastomeric material such as ESTANE (Trademark) polymer. Preferably it has a Durometer of between forty and sixty on the Shore A hardness scale. The sealing ring 70 functions as a gasket when installed in the outer housing 12. The support ring 68 has a stepped configuration as best seen in FIGS. 9 and 17. This stepped configuration includes the shoulder 60 (FIGS. 1 and 9). The sealing ring 70 has a disk-shaped generally flat or planar horizontal portion 70*a* (FIG. 9) that overlies an upper side of the support ring 68. The sealing ring 70 also has a cylindrical vertical portion 70*b* (FIG. 9) that overlies an inner vertical annular surface of the support ring 68. The horizontal portion 70*a* of the sealing ring 70 has a tapered inner edge 74 that engages an exterior surface of the riser 20.

Referring to FIG. 2, the horizontal portion 70*a* of the sealing ring 70 extends across the gap 72 in the support ring 68. The segment of the sealing ring 70 that extends between the opposite ends 68*a* and 68*b* of the support ring 68 simply folds or bends when the containment ring 16 is radially contracted to insert the same within the outer housing 12. When the containment ring 16 is thereafter allowed to return to its radially expanded retaining position, the portion of the sealing ring 70 that extends between the ends 68*a* and 68*b* of the support ring flattens out. In this condition, the ends 68*a* and 68*b* of the support ring 68 are disengaged, i.e. spaced apart, with a flat segment of the sealing ring portion 70 extending therebetween and connecting the ends 68*a* and 68*b*.

The rigid support ring 68 thus provides the structural support and resiliency required in the containment ring 16, while the sealing ring 70 provides a soft gasket that seals the clearance space between the inner annular surface of the outer housing 12 and the riser 20. This seal prevents dirt and/other debris from entering this clearance space where it often impairs fall extension and/or retraction of the riser 20.

It is highly desirable to provide a unitary containment ring 16 having both a rigid support portion and an elastomeric seal portion. This facilitates installation of the containment ring by a repairman after the riser 20 has been removed for servicing and re-inserted into the outer housing 12. It is not practical to provide both such portions in a containment ring made of a single material. Attempts to co-mold the two portions to provide a thermal fusion bond therebetween were unsuccessful due to the different chemical properties of suitable rigid plastics and elastomers. It would be too expensive and unreliable to adhesively attach a separate sealing ring to a support ring. In accordance with the present invention the support ring 68 and sealing ring 70 can be reliably and inexpensively connected on a permanent basis by configuring them to provide a mechanical interlock therebetween. More particularly, the support ring 68 is preferably formed with a plurality of passages therethrough, such as circumferentially spaced holes 76. In addition, the upper side of the support ring 68 is formed with an upwardly opening annular channel 78 (FIGS. 10 and 13) which communicates with the holes 76. The under side of the support ring 68 is formed with a downwardly and inwardly opening channel 80 (FIG. 12) which also communicates with the holes 76.

The support ring 68 is injection molded first, removed from its mold, and then inserted into a second mold where the elastomeric sealing ring 70 is co-molded to the support ring 68. During the second molding step, liquid or molten elastomeric material flows around the upper and inner vertical side surfaces of the support ring 68, into the upper channel 78, through the holes 76 and into the lower channel 80. When the elastomeric material hardens and/or solidifies it forms vertical cylindrical extensions or posts 82 (FIG. 9) that extend through corresponding ones of the holes 76 in the support ring 68 and wrap around the underside of the support ring 68. As shown in FIG. 9, continuous loops of elastomeric material are thus formed that encircle portions of the support ring 68 to provide at least a portion of the mechanical interlock between the rigid support ring 68 and the elastomeric sealing ring 70. These loops consist of the horizontal portion 70*a* of the sealing ring 70, the vertical cylindrical extensions 82, horizontal connecting portions 84 and the cylindrical vertical portion 70*b* of the sealing ring 70. The unitary construction of the containment ring 16 is very advantageous in that it permits the ring 16 to be readily removed and re-installed in the outer housing 12, thereby facilitating repair or replacement of the riser 20.

Figure 8:
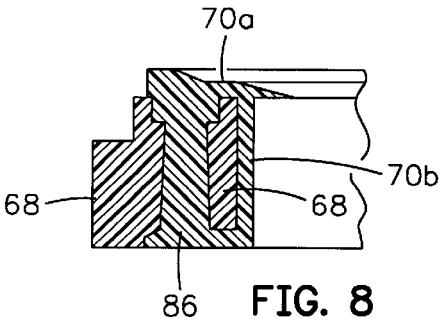
FIG. 8 is an enlargement of the circled portion of FIG. 6.

To facilitate injection of the material into the respective molds, it is advantageous to enlarge the opposing ends 68*a* and 68*b* of the support ring and the adjacent opposing ends 70*c* and 70*d* (FIG. 5) of the cylindrical vertical portion of the sealing ring 70. The tapered holes 85 (FIGS. 16 and 17) through the opposite ends 68*a* and 68*b* of the support ring 68 are thus larger in diameter than the holes 76. FIG. 8 illustrates the larger tapered posts 86 that are formed in these larger holes.

While the present invention has been illustrated and described by way of a specific embodiment, it should be understood that numerous changes and modifications can be made therein without departing from the spirit and scope of the present invention. For example, it is not necessary to co-mold the support ring and sealing ring together. The sealing ring 70 could be molded without the connection portions 84 (FIG. 9). This way the individual vertical cylindrical extensions or post 82 could be press fit into the holes 76 in the support ring to form a modified containment ring. This modification has the advantage of eliminating the co-molding process that requires special tooling and labor to insert the pre-molded support ring 68.

Therefore the protection afforded the present invention should only be limited in accordance with the scope of the following claims.

What is claimed is:

1. A pop-up sprinkler, comprising:

an elongated housing having an inlet end for connecting to a source of pressurized water, an outlet end and a central bore;

an elongated riser reciprocally mounted in the bore and movable between a retracted position within the bore and an extended position, the riser being responsive to a source of pressurized water for moving to the extended position in the bore;

spring means for normally biasing the riser to the retracted position;

a shoulder formed at the outlet end of the housing; and a radially retractable and expandable containment ring mounted at the outlet end and engaging the shoulder for retaining the spring in the bore, the containment ring having a support ring made of a substantially rigid material and a sealing ring made of an elastomeric material co-molded to the support ring, the support ring being split to define opposite ends with a gap therebetween, the split in the support ring enabling radial expansion and contraction of the support ring, and the sealing ring extending across the gap when the containment ring is in a radially expanded retaining position engaging the shoulder at the outlet end of the housing to prevent dirt and/or other debris from entering between the housing and the riser.

2. A sprinkler according to claim 1 wherein the support ring and the sealing ring are configured to provide a mechanical interlock therebetween.

3. A sprinkler according to claim 2 wherein the support ring is formed with a plurality of passages into which portions of the sealing ring extend.

4. A sprinkler according to claim 3 wherein the passages include a plurality of circumferentially spaced holes that extend through the support ring.

5. A sprinkler according to claim 1 wherein the support ring has a stepped configuration.

6. A sprinkler according to claim 1 wherein the opposite ends are in disengagement and the sealing ring extends between the opposite ends when the containment ring is installed.

7. A sprinkler according to claim 1 wherein the sealing ring overlies an upper side of the support ring.

8. A sprinkler according to claim 7 wherein the sealing ring extends in a radially inward direction and has an inner edge that engages an exterior surface of the riser.

9. A sprinkler according to claim 1 wherein the sealing ring overlies an upper side of the support ring and an inner vertical surface of the support ring.

10. A containment ring for the riser retraction spring of a pop-up sprinkler, comprising:

a radially retractable and expandable unitary ring adapted to be mounted at an outlet end of a housing of a sprinkler for retaining a spring and a riser in a central bore of the housing, the unitary ring including a support ring made of a substantially rigid material and a sealing ring made of an elastomeric material connected to the support ring, the support ring being split to define opposite ends with at gap therebetween, the split in the support ring enabling radial expansion and contraction of the support ring, the sealing ring extending across the gap when the containment ring is in a radially expanded retaining position in the outlet end of the housing to prevent dirt and/or other debris from entering between the housing and the riser, and further wherein the sealing ring extends through a plurality of passages in the support ring and around portions of the support ring to form continuous loops of elastomeric material that provide at least a portion of a mechanical interlock between the support ring and the sealing ring.

11. A containment ring according to claim 10 wherein the sealing ring is co-molded to the support ring.

12. A containment ring according to claim 10 wherein the passages include a plurality of circumferentially spaced holes that extend in an axial direction.

13. A containment ring according to claim 10 wherein the support ring has a stepped configuration.

14. A containment ring according to claim 13 wherein the plurality of passages extend vertically through the support ring and the support ring is further formed with at least one channel communicating with one set of ends of the passages.

15. A containment ring according to claim 10 wherein the sealing ring extends in a radially inward direction and has a tapered inner edge for engaging an exterior surface of the riser.

16. In a pop-up sprinkler having a fixed outer housing with a riser vertically extensible from a bore of the housing in response to source of pressurized water connected to the housing being turned ON and vertically retracted by a coil spring surrounding the riser when the source of pressurized water is turned OFF, the coil spring being positioned so that a lower end of the coil spring engages a lower portion of the riser, the improvement comprising a containment ring fixedly positioned at an upper end of the outer housing for retaining an upper end of the coil spring, the containment ring having a unitary construction including a substantially resilient support ring and an elastomeric sealing ring co-molded to the support ring, the sealing ring being configured to substantially close any clearance space between the riser and the outer housing to prevent the entry of dirt and/or other debris that might otherwise impair the extension and/or retraction of the riser relative to the fixed outer housing.

* * * * *